United States Patent [19]

Brenner et al.

[11] Patent Number: 4,837,882

[45] Date of Patent: Jun. 13, 1989

[54] FLOTATION CONTROLLED DRIVE FOR AN AUTOMATIC WASHER

[75] Inventors: Robert A. Brenner, St. Joseph Township, Berrien County; Anthony Mason, Lincoln Township, Berrien County, both of Mich.

[73] Assignee: Whirlpool Corporation, Benton Harbor, Mich.

[21] Appl. No.: 133,630

[22] Filed: Dec. 15, 1987

[51] Int. Cl.[4] ..... D06F 37/40

[52] U.S. Cl. ..... 8/159; 68/23.7; 192/18 R; 192/89 W

[58] Field of Search ..... 8/159; 68/23.7, 133; 192/18 R, 67 P, 89 W

[56] References Cited

U.S. PATENT DOCUMENTS

| | | | |
|---|---|---|---|
| 1,773,334 | 8/1930 | Altorfer | 68/133 |
| 2,001,965 | 5/1935 | Kirby | 68/23.7 |
| 2,167,086 | 7/1939 | Page | 68/23.7 |
| 2,219,680 | 10/1940 | Caldwell | 68/23.7 |
| 2,268,204 | 12/1941 | Dunham | 68/23.7 |
| 2,579,598 | 12/1951 | Morrison | 68/23.7 |
| 2,610,498 | 9/1952 | Geldhof et al. | 68/23.7 |
| 2,665,576 | 1/1954 | Thiele | 68/23.7 |
| 4,254,641 | 3/1981 | Gauer et al. | 68/23.7 |

FOREIGN PATENT DOCUMENTS

| | | | |
|---|---|---|---|
| 1049418 | 12/1953 | France | 68/133 |

*Primary Examiner*—Harvey C. Hornsby
*Assistant Examiner*—Stephen F. Gerrity
*Attorney, Agent, or Firm*—Hill, Van Santen, Steadman & Simpson

[57] ABSTRACT

The present invention concerns a spin basket clutching device which includes a flotation device which locks the spin basket to an agitator in response to the level of wash liquid in the basket. During a wash step, the basket will be full of liquid and the flotation device floats within an inverted pocket located on the agitator skirt. During a spin step, the basket will be empty of liquid and the flotation device will drop partially out of the inverted pocket and rest partially within a pocket on the spin basket, thus locking the agitator to the spin basket for concurrent rotation. Also disclosed is a device which responds oppositely to the level of wash liquid in the wash tub locking the spin basket to the wash tub to prevent rotation of the basket during agitation of the wash liquid by the agitator during the wash step and unlocking the basket from the tub in a low liquid level step such as spin.

16 Claims, 3 Drawing Sheets

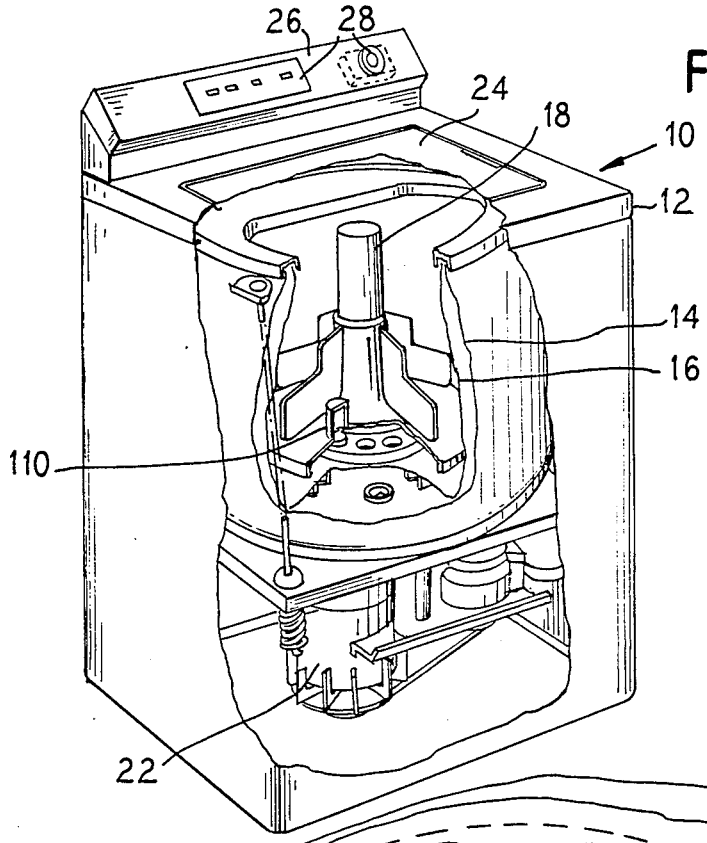
FIG. 1
FIG. 3
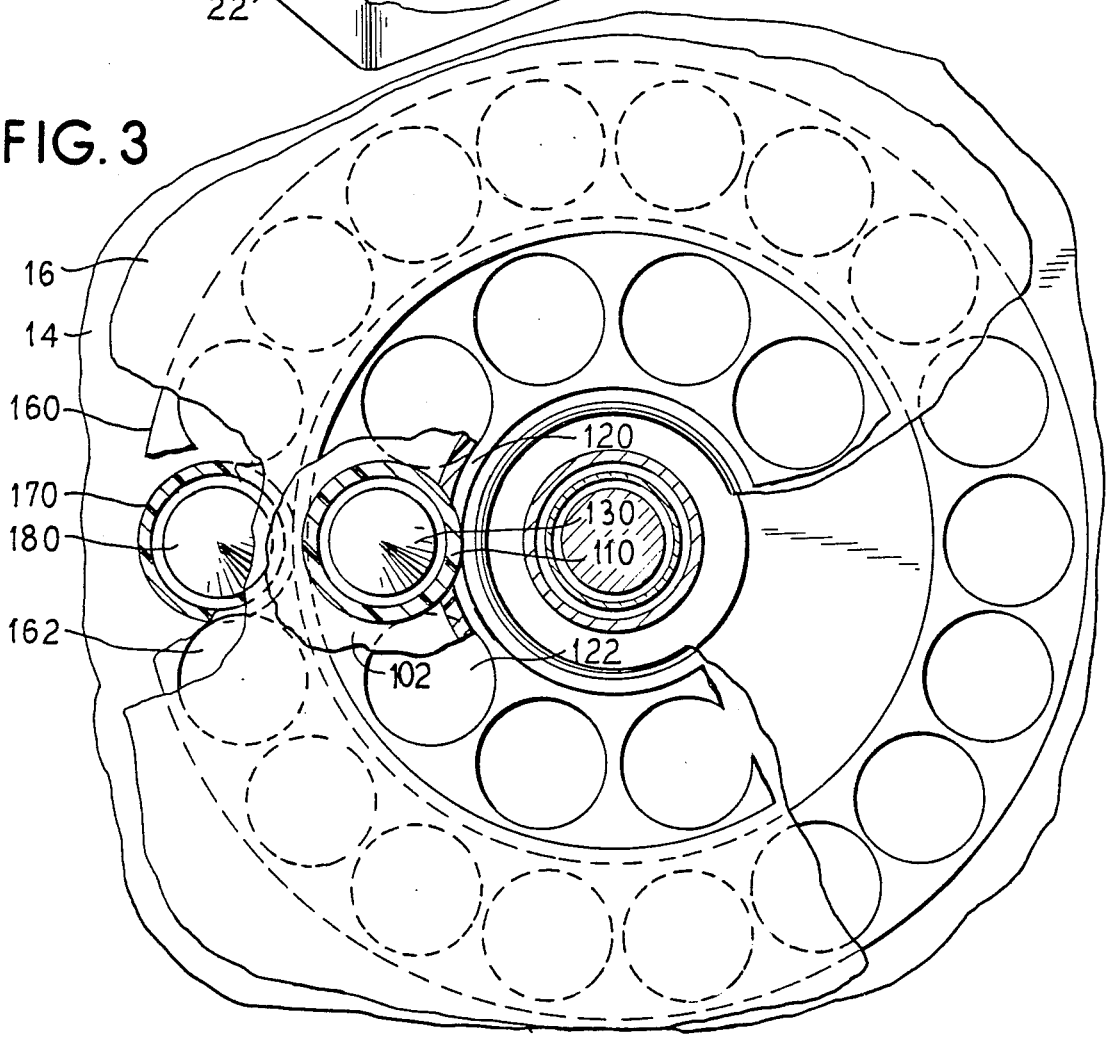

FLOTATION CONTROLLED DRIVE FOR AN AUTOMATIC WASHER

BACKGROUND OF THE INVENTION

1. Field of the Invention

The present invention relates generally to a clutch mechanism for an automatic washer and specifically to a device for providing a drive connection to a wash basket during selected portions of a wash cycle.

2. Description of the Prior Art

In the drive of an automatic washer, the agitator is driven selectably in a back and forth oscillating agitating motion or in a single direction spinning motion depending upon the particular portion of the wash cycle: the wash, rinse or centrifuge steps. Additionally, the wash basket is selectibly held fixed or caused to spin relative to a wash tub depending upon the particular portion of the wash cycle.

Various locking or clutching mechanisms have been disclosed in the prior art which engage or lock an agitator or wash basket to a drive. The description of several references are provided.

U.S. Pat. No. 2,167,086 discloses a clutching mechanism which includes a pair of plates which engage corresponding projections. A basket is permitted to be raised or lowered relative to the agitator and a drive shaft connected to the agitator by means of a lever. One plate is raised to engage projections on the bottom of the wash basket and to raise the basket relative to the agitator. The basket is then fixed relative to a wash tub and disengaged from the agitator drive. When the plate is lowered, the basket is lowered and a second set of projections engages a second plate attached to the agitator drive shaft. The first plate is lowered further until it is completely disengaged from the basket. At that time, the wash basket is coupled to the agitator drive for spinning. The agitator is never disengaged from its drive.

U.S. Pat. No. 2,219,680 discloses another agitator which is fixedly mounted on a drive shaft. There is included a ring with inwardly extending lugs mounted inside the agitator. A complementary ring with outwardly extending lugs for engaging the inwardly extending lugs is mounted concentrically on the wash basket. During the washing step when only agitation is desired, the agitator is permitted to oscillate, without causing the basket to move, in an arc limited by the space between the two sets of lugs. During the spin step, when it is desired to spin the basket, a continuous rotation of the agitator causes the two sets of lugs to engage and accordingly, the basket to rotate with the agitator.

U.S. Pat. No. 2,268,204 discloses a washing machine with a wash tub supported on a spring which deflects vertically downward whenever the tub is sufficiently filled with washing liquid. When it is deflected, a conical member located about a central shaft engages a seat. The arrangement serves to stabilize the tub during washing and at the beginning of the spin step. The drive mechanism which oscillates the agitator is located within the central shaft. Thus, the agitator and basket are driven separately.

U.S. Pat. No. 2,665,576 discloses yet another washing machine wherein the agitator is driven by a shaft located within a shaft which separately drives the basket. Gearing devices are used to separately drive the agitator or basket shafts in oscillatory or continuous motion, respectively.

It is desirable to provide an automatic washer with means for clutching the basket and agitator drives such that both the agitator and basket are spun together in a spin step while the agitator alone is oscillated or agitated in a wash or rinse step. The art has provided some ways for undertaking this function but all are relatively cumbersome, complicated or expensive.

SUMMARY OF THE INVENTION

The present invention provides a device which locks a basket to an agitator, which is fixedly mounted on a drive shaft, in response to the level of wash liquid in the basket. Thus, the basket may be driven by the agitator whenever the wash liquid level is such that the basket and agitator are locked together.

When the wash liquid is high, as during a washing step, the basket is disengaged or unlocked from the agitator. When the wash liquid is low, as during a spinning step, the basket is locked to the agitator.

There is also provided a similar device which locks the wash basket to a wash tub surrounding the basket in response to the wash liquid level in the tub. When the wash liquid level is high, as during a washing step, the basket is locked to the tub to prevent movement of the basket. When the wash liquid level is low, as during a spinning step, the basket is unlocked from the tub to permit the basket to spin to extract liquid from the contents of the basket.

The two locking devices are similar in construction and concept but they operate oppositely in response to the wash liquid level. The device which locks the agitator to the basket comprises a deep inverted pocket mounted on the skirt of the agitator and a ring of shallow pockets mounted on the inside of the floor of the basket. Similarly, the device which locks the tub to the basket comprises a deep pocket located in the floor of the tub and a ring of shallow pockets mounted on the bottom side of the floor of the basket. Both devices comprise hollow or light weight articles which float in water.

In operation, when the wash liquid in the basket is high, the basket is locked to the tub and the agitator is not locked to the basket. The flotation device of the device for locking the agitator to the basket floats completely without the deep inverted pocket located on the agitator skirt. The flotation device of the device for locking the basket to the tub floats partially within a shallow pocket of the ring located underneath the basket and partially within the deep pocket located on the tub floor.

When the wash liquid level is low, the basket is not locked to the tub and the basket is locked to the agitator. The flotation device of the device for locking the basket to the agitator rests partially within a shallow pocket of the ring located inside the basket and protrudes partially into the deep pocket mounted on the agitator skirt. The flotation device of the device for locking the basket to the tub rests completely within the deep pocket located on the tub floor.

This arrangement eliminates the need for cumbersome or complex clutching arrangements for drives for the basket and agitator. With the present invention, there need only be provided a single drive shaft coupled to a reversible motor. When the washer is in a wash step, the motor will drive the shaft in an oscillatory fashion. The wash liquid level will be high and the wash basket will not be locked to the agitator. Thus only the agitator will be driven during a washing step.

However, when the washer is in a spinning step, or just about ready to go into a spinning step, the wash liquid level will be low and the agitator will be locked to the basket. The basket will be unlocked from the tub and thus, the agitator and basket will be driven together.

BRIEF DESCRIPTION OF THE DRAWINGS

FIG. 1 is a perspective view of an automatic washing machine, partially cut away, embodying the principles of the present invention.

FIG. 3 is a sectional view, partially cut away, of the agitator, wash basket and wash tub of the washer of FIG. 1 wherein the locking rings are shown taken generally along the line III—III of FIG. 2.

DESCRIPTION OF THE PREFERRED EMBODIMENT

Figure 2:
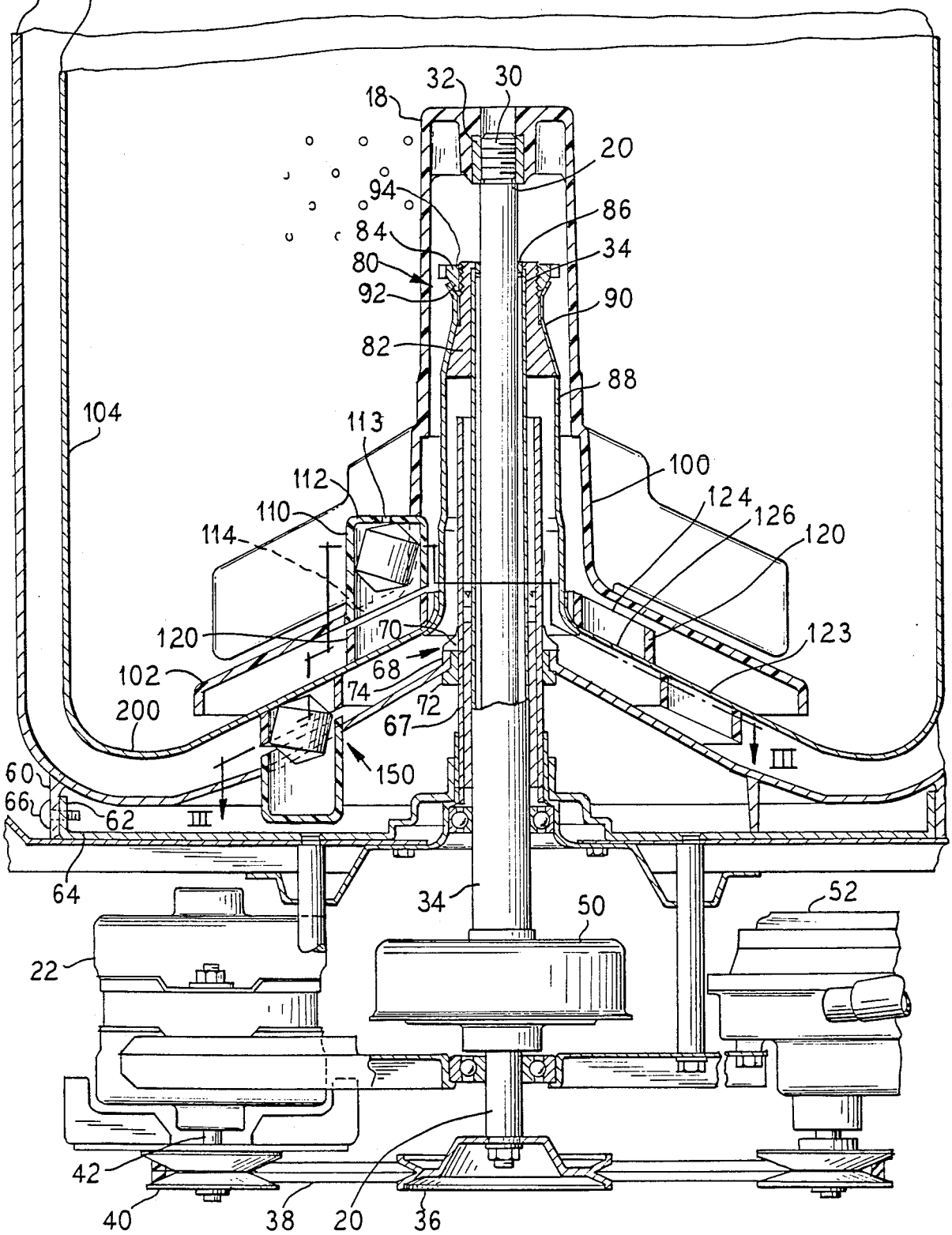
FIG. 2 is a side sectional view through the interior of the washing machine of FIG. 1 and showing the basket locked to the tub.

In FIG. 1 there is shown an automatic washer generally at 10 having an outer cabinet 12 to surround and enclose a wash load receptacle. The wash load receptacle comprises an imperforate wash tub 14 and a concentrically mounted inner perforate wash basket 16. A vertical axis agitator 18 is concentrically located within the wash basket 16 and is driven by means of an agitator drive shaft 20, not shown, which extends through the floor of the wash tub 14 and the floor of the wash basket 16. The shaft 20 is driven by a reversible motor 22 as described below.

The washer cabinet 12 has a top openable lid 24 and has a console 26 at the rear edge of the top of the washer which includes a plurality of control dials 28 that permit a user to select a series of automatic washing, rinsing and spinning steps.

The interior of the washer is shown in greater detail in FIG. 2 where it is seen that the agitator 18 is connected to the shaft 20 by appropriate fastening means which may include a threaded end 30 on the shaft 20 and a corresponding threaded hole 32 in the agitator 18.

The shaft 20 extends downwardly into a spin tube 34 and is secured to a drive pulley 36. The pulley 36 is connected by means of a drive belt 38 to a drive pulley 40 mounted on a drive shaft 42 of the reversible motor 22. This type of drive arrangement has many advantages, such as being able to quickly change pulley diameters to cause the machine to run at different speeds, for example, when switching between 60 cycle current and 50 cycle current.

The spin tube 34 is mounted on top of brake means 50 such that it is free to rotate thereon. Thus the tube 34 act as a bearing extension so that anything attached to it may also freely rotate about the agitator shaft.

The brake 50 is used to stop the agitator shaft from spinning or oscillating at the end of a step or whenever the lid 24 is opened for safety purposes.

There is also provided a pump 52 which is used to extract wash liquid from the tub 14. Because the basket 16 is perforate, the pump 52 necessarily extracts wash liquid from the basket 16. The wash liquid is extracted generally, at the end of a wash step, at the end of a rinse step and during a spin step. During a spin step, as is well known in the art, the basket 16 is spun at a high rate of rotation to cause it to act as a centrifuge to extract wash liquid from articles contained therein. The pump 52 is connected to a drain hole, not shown, in the tub 14.

The wash tub 14 is shown as being supported by lugs 60 which are secured to lugs 62 on base plate 64 by bolts 66. The wash tub 14 is also secured about center post 67, which surrounds spin tube 34, by sealing means 68. Sealing means 68 comprises two annular rings, 70 and 72 which clamp together about the center hole 74 of the wash tub 14.

The wash basket 16 is supported on spin tube 34 by wedge means 80. Wedge means 80 comprises an annular wedge 82 and an annular wedge nut 84. The annular wedge 82 has an annular ring 86 which protrudes inwardly and which hooks onto the end of the spin tube 34. Thus the wedge 82 hangs from the spin tube 34.

The wash basket 16 further comprises a central tube 88 with inwardly bent end 90. Because of the shape of the end 90 the wash basket is placed on the wedge 82 such that it too hangs form the spin tube 34.

The wedge nut 84 further comprises wedged portion 92 in addition to its inner threaded portion 94. As wedge nut 84 is tightened, the wedged portion 92 is driven into the space between the wedge 82 and the tube end 90 forcing the end 90 downward to fit tightly onto the wedge nut 84 and the wedge 82. Thus the wash basket 16 is made to fit tightly onto spin tube 34 yet is permitted to rotate freely on spin tube 34 about agitator shaft 20.

During a normal wash step, the agitator 18 is oscillated about its vertical axis by the reversible motor 22 such that the lower vanes operate as pumping arms to cause a toroidal flow of wash liquid downwardly along the agitator body 100 and outwardly along the skirt 102 and upwardly along the wall 104 of the wash basket. The toroidal flow increases turnover of clothes and the like within the wash basket to enhance washability.

Referring now to FIGS. 1–4, the clutching mechanism of the preferred embodiment will be described.

There is provided on the agitator skirt 102 a tall or deep inverted pocket 110. Such pocket may be formed concurrently with the agitator 18 such that they comprise an integral article. Alternatively, the pocket 110 may be formed separately from the agitator 18 and secured thereon by means well known in the art. Preferably, both the agitator 18 and the pocket 110 are made of plastic material, however any suitable material may be used withtout departing from the spirit of the invention.

Figure 8:
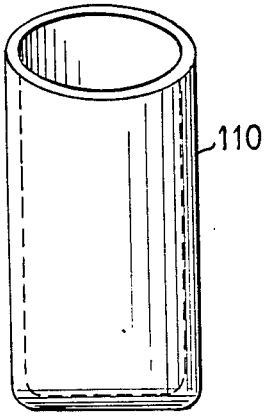
FIG. 8 is a side elevational view of a pocket used in the washer of FIG. 1.

The pocket 110 preferably comprises a hollow cylindrical shape with closed top end 112 having an air vent 113 therein. As such, the pocket looks like an inverted cup. An open bottom end 114 of the pocket 110 is angled as is shown most clearly in FIGS. 2, 4 and 8 to match the contour of the agitator skirt through which it extends.

Figure 4:
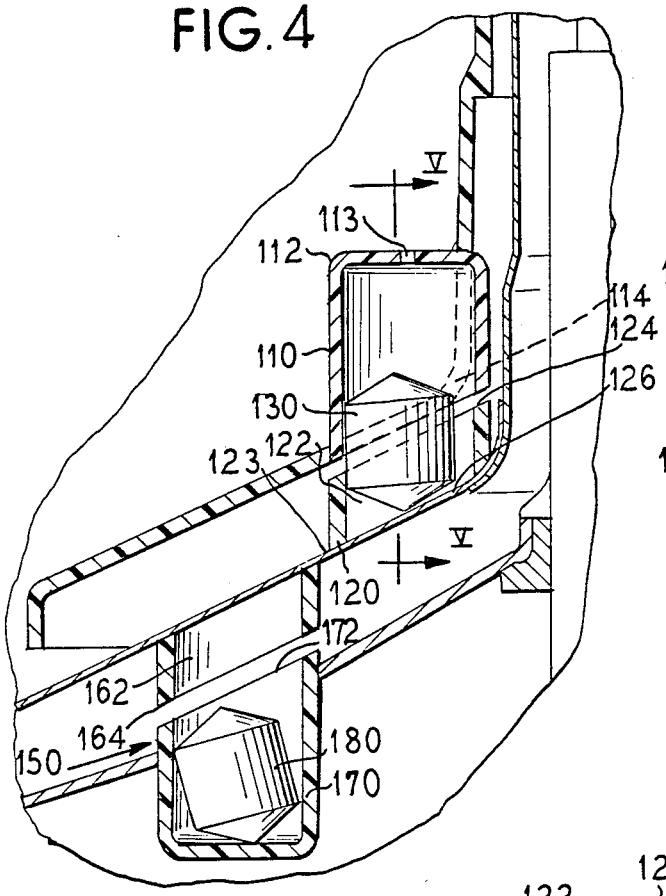
FIG. 4 is a partial side sectional view of the agitator, wash basket and wash tub of the washer of FIG. 1 showing a flotation device clutching mechanism embodying the principles of the invention with the basket locked to the agitator.
Figure 7:
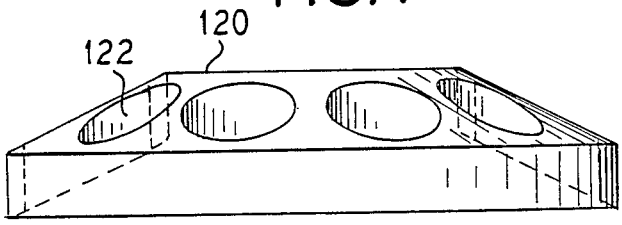
FIG. 7 is a side elevational view of a locking ring of the washer of FIG. 1.

There is also provided a ring 120 of short or shallow pockets 122 located on an inside floor 123 of the basket 16 concentrically about agitator shaft 20. The ring 120 is located and sized such that the shallow pockets 122 may be vertically aligned with the deep pocket 110. As is shown in FIGS. 2, 4 and 7, the shallow pockets have angled open top ends 124 and closed bottom ends 126 formed by the basket bottom wall or floor.

Figure 5:
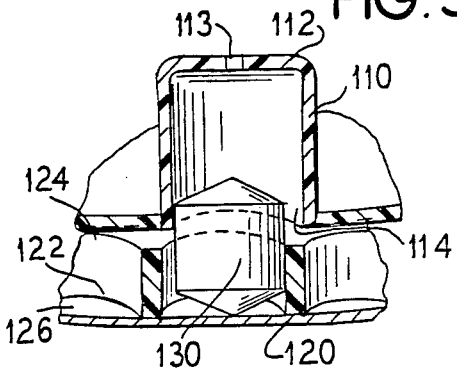
FIG. 5 is a partial sectional view taken generally along the line V—V of FIG. 4.

Placed within the deep pocket 110 is a flotation device 130 which will float in the wash liquid. Whenever the level of wash liquid in the basket 16 is below the height of the ring 120, the flotation device 130 will not float and will rest in one of the shallow pockets 122 of the ring 120. As is shown in FIGS. 4 and 5, the flotation device 130 is much longer than the shallow pockets 122 and therefore, it protrudes into the agitator's deep pocket 110. As such, the flotation device 130 acts like a pin to lock the agitator 18 to the basket 16.

However, when the level of wash liquid in the basket 16 is above the level of the ring, the flotation device 130 will float up into the agitator's deep pocket 110. As is shown in FIG. 2, the entire flotation device 130 fits within the deep pocket 110. Hence, when the basket 16 is sufficiently full of wash liquid, the flotation device 130 will disengage from the ring 120 and no longer act as a pin to lock the basket 16 to the agitator 18.

It is apparent then that when the basket 16 is sufficiently full of wash liquid, the agitator 18 is permitted to oscillate free of the basket. Conversely, when the basket 16 is sufficiently empty of wash liquid, the basket is locked to the agitator and both will rotate together.

As discussed earlier, in FIGS. 2, 4 and 8 it is shown that the open end 114 of pocket 110 and open ends 124 of pockets 122 have angled edges. The open end 114 is aligned with the open ends 124 such that the pocket 110 and any given pocket 122 would form a cylinder. This angling of the open ends provides the best locking capability for a flotation device 130 used in connection with the angled profile agitator skirts used extensively in the industry.

Figure 9:
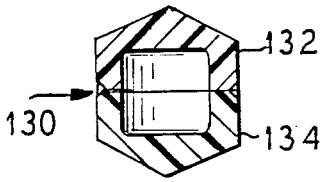
FIG. 9 is a sectional view of a flotation device used in a clutch embodying the principles of the invention.

As is shown in FIG. 9, the flotation device 130 comprises two cylindrical-conical portions 132 and 134. The conical portions are included to permit the flotation device 130 to more easily penetrate a pocket which may only be partially exposed due to partial alignment between the deep pocket 110 and any given shallow pocket 122.

Figure 10:
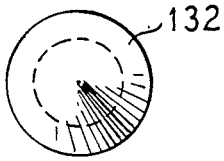
FIG. 10 is a plan view of the flotation device of FIG. 9.

The flotation device 130 is preferably made of a plastic or like material. But, any material which will produce a rigid device which will float in water might be usable. With the use of plastic material, the two cylindrical-conical halves may be formed separately and then sealed together by means well known in the art, such as by spin welding or gluing to produce the device of FIGS. 9 and 10. Moreover, the flotation devices may be of solid construction so long as the specific gravity of the device is less than that of the wash liquid.

When the flotation device 130 is in locked position, the conical shape causes it to stand vertically due to the angled profile of the floor of the basket 16. Thus, the angling of the open ends 114 and 124 is provided to cut across as much of the cylindrical surface area of the flotation device 130 as possible so that the greatest amount of the device 130 is located in both the deeper pocket 110 and any given shallower pocket 122. This assures locking.

There is also shown in the embodiment of FIGS. 1–4 and 6 another locking mechanism designated generally 150, which is similar to the one described above. The inclusion of this mechanism is optional as it serves merely to lock the basket 16 to the tub 14 but not to any drive means.

The mechanism 150 comprises a ring 160 which is similar to the ring 120. However ring 160 is larger in diameter and because of the larger diameter it contains a larger number of shallow pockets 162, that the number of shallow pockets 122. As is shown clearly in FIGS. 2 and 4, the ring 160 is located underneath the basket 16 with open ends 164 of the pockets 162 facing the tub 14.

The mechanism 150 further comprises a deep pocket 170 located in the floor of tub 14. An open end 172 of the deep pocket 170 faces the underside of the basket 16 in vertical alignment with a pocket 162.

Disposed within the deep pocket 170 is a flotation device 180 which may be exactly the same as flotation device 130. However, in mechanism 150, the flotation device 180 serves to lock the basket to the tub when the wash liquid level is high.

Figure 6:
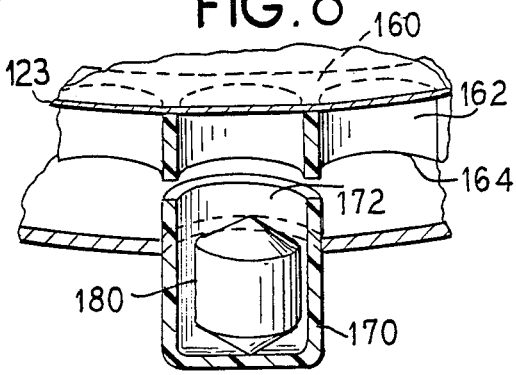
FIG. 6 is a partial sectional view taken generally along the line VI—VI of FIG. 4.

It is appreciated from FIGS. 2, 4 and 6, that when there is no wash liquid in the tub 14 above the level of the ring 160, the flotation device 180 does not float and instead rests within deep pocket 170. However, when tub 14 is sufficiently full of wash liquid, the flotation device 180 will float upwards until it engages one of the shallow pockets 162 on ring 160 to lock the tub 14 to the basket 16. Thus, when the washer is in a wash step and full of wash liquid, the basket 16 will be locked to tub 14 and will be prevented from moving in response to agitation of wash liquid. Conversely, when the washer is in a spin step, the basket 16 will not be locked to tub 14 and will be free to spin.

Two arrangements may be employed to permit the flotation device 180 to rest within the deeper pocket 170 when the wash liquid is extracted from the wash tub 14. In the first arrangement, shown in the drawings, no drain is provided to permit accumulated liquid to drain from the pocket 170. However, the flotation device 180 is of such specific gravity that it barely floats in the remaining liquid and will be contained within the pocket 170. Thus, the mechanism 150 will unlock when the wash liquid is extracted from the wash tub.

Alternatively, a drain line, not shown in the drawings, may be provided to allow fluid communication between the bottom of the pocket 170 and a portion 200 of the wash tub 14 which is below the open end 172 of the pocket 170. Such a drain line would permit all or most of the wash liquid to drain from the pocket 170 and, therefore, allow the flotation device 180 to rest completely within the pocket 170. Additionally, there is no need to utilize a valve with the drain line because it will not be draining when the wash liquid level is at or above the bottom of the pocket 170.

It can be appreciated by those in the art that removal of the mechanism 150 from the washer is optional because the basket 16 may be hindered from movement due to agitation of the wash liquid simply by inertia. Mechanism 150 offers a means to ensure prevention of such movement only. It can also be appreciated that a washing machine embodying the principles of the instant invention could comprise the mechanism 150 only, the agitator and tub being driven by alternate means known in the art.

Although changes and modifications of the present invention may be apparent to those skilled in the art, it should be understood that such changes and modifications are included within the patent as may reasonably and properly be included within the scope of the present contribution to the art.

The embodiments of the invention in which an exclusive property or privilege is claimed are defined as follows:

1. An automatic laundry washer comprising:
a wash tub for containing wash liquid;
a spin basket rotatably mounted within said wash tub;
a vertical axis agitator mounted within said spin basket on a drive shaft extending through said spin basket and said wash tub; and
means responsive to the level of wash liquid in said spin basket for locking and not locking said spin basket to at least one of said agitator or wash tub, said means comprising a flotation device that mechanically engages and disengages between said spin basket and said one of said agitator or wash tub.

2. An automatic laundry washer as set forth in claim 1 wherein said flotation device comprises a cylindrically shaped middle portion and conically shaped end portions.

3. An automatic laundry washer as set forth in claim 2 wherein said flotation device further comprises a rigid, plastic article.

4. An automatic laundry washer as set forth in claim 3, wherein said means for not locking said agitator to said spin basket further comprises first pocket means for containing said flotation device in said agitator when the level of wash liquid is sufficiently high.

5. An automatic laundry washer as set forth in claim 4, wherein said means for locking said agitator to said spin basket further comprises second pocket means located on said spin basket for aligning with said first pocket means for containing such flotation devices and for partially containing said flotation device when the wash liquid level is sufficiently low to lock said agitator to said spin basket.

6. An automatic laundry washer as set forth in claim 5, wherein said second pocket means comprises an annular ring with a plurality of pockets, the depths of which are less than the depth of said first pocket means.

7. An automatic laundry washer, comprising:
a wash tub for containing wash liquid;
a spin basket rotatably mounted within said wash tub;
a vertical axis agitator mounted within said spin basket on a drive shaft extending through said spin basket and said wash tub; and
means responsive to the level of wash liquid in said spin basket for not locking said agitator to said spin basket comprising first pocket means for containing a flotation device in said agitator when the level of wash liquid is sufficiently high.

8. An automatic laundry washer as set forth in claim 7, wherein said means responsive to the level of wash liquid further comprises means for locking said agitator to said spin basket comprising second pocket means located on said spin basket for aligning with said first pocket means for containing said flotation device and for partially containing said flotation device when the wash liquid level is sufficiently low to lock said agitator to said spin basket.

9. An automatic laundry washer as set forth in claim 8, wherein said second pocket means comprises an annular ring with a plurality of pockets, the depths of which are less than the depth of said first pocket means.

10. An automatic laundry washer, comprising:
a wash tub for containing wash liquid;
a spin basket rotatably mounted within said wash tub;
a vertical axis agitator mounted with said spin basket and a drive shaft extending through said spin basket and said wash tub; and
means responsive to the level of wash liquid in said wash tub for not locking said spin basket to said wash tub comprising first pocket means for containing a flotation device in said wash tub when the level of wash liquid is sufficiently low.

11. An automatic laundry washer as set forth in claim 10, wherein said means responsive to said level of wash liquid further comprises means for locking said spin basket to said wash tub comprising second pocket means located on said spin basket for aligning with said first pocket means for containing said flotation device and for partially containing said flotation device when the wash liquid level is sufficiently high to lock said spin basket to said wash tub.

12. An automatic laundry washer as set forth in claim 11, wherein said second pocket means comprises an annular ring with a plurality of pockets, the depths of which are less than the depth of said first pocket means.

13. An automatic laundry washer comprising:
a wash tub for containing wash liquid;
a spin basket rotatably mounted within said wash tub;
a vertical axis agitator mounted within said spin basket on a drive shaft extending through said wash tub and said spin basket; and
means responsive to the level of wash liquid in said spin basket for locking and not locking said spin basket to said agitator comprising a flotation device the specific gravity of which is less than that of water, said means for not locking further comprising first pocket means with an open end located on said agitator for completely containing said device when the wash liquid level is higher than said first pocket means and partially containing said device when the wash liquid level is below said first pocket means and partially containing said device when the wash liquid level is below said first pocket means, and said means for locking further comprising second pocket means located on said basket for aligning with said first pocket means and for partially containing said device when the wash liquid level is below said first pocket means;
whereby when the wash liquid level is above said first pocket means, said agitator is not locked to said spin basket but when the wash liquid level is below said first pocket means, said agitator is locked to said spin basket.

14. An automatic laundry washer comprising:
a wash tub for containing wash liquid;
a spin basket rotatably mounted within said wash tub;
a vertical axis agitator mounted within said spin basket on a drive shaft extending through said wash tub and said spin basket; and
means responsive to the level of wash liquid in said spin basket for locking and not locking said spin basket to said tub comprising a flotation device, the specific gravity of which is less than that of water, said means for not locking further comprising first pocket means with an open end located on said wash tub for containing said device when the level of wash liquid is sufficiently low and for partially containing said device when the level of wash liquid is above said first pocket means and said means for locking further comprising second pocket means located underneath said spin basket for aligning with said first pocket means and for partially containing said device when the level of wash liquid is sufficiently high;

whereby said spin basket is locked to said wash tub when the wash liquid level is sufficiently high and said spin basket is not locked to said wash tub when the wash liquid level is sufficiently low.

15. A method for driving a spin basket in an automatic laundry washer having a wash tub for containing wash liquid and in which said spin basket is rotatably mounted and having a vertical axis agitator rotatably mounted within said spin basket on a drive shaft extending through said wash tub and said spin basket comprising the following steps:

engaging a flotation device to mechanically lock said agitator to said spin basket in response to a sufficiently low level of wash liquid in said spin basket so that said agitator drives said spin basket for concurrent rotation therewith; and disengaging said flotation device to mechanically not lock said agitator to said spin basket in response to a sufficiently high level of wash liquid in said spin basket so that said agitator rotates independently of said spin basket.

16. A method as set forth in claim 15, further comprising the following steps:

engaging a second flotation device to mechanically lock said spin basket to said wash tub in response to a sufficiently high level of wash liquid in said wash tub whereby said spin basket cannot rotate within said wash tub; and disengaging said second flotation device to mechanically not lock said spin basket to said wash tub in response to a sufficiently low level of wash liquid in said wash tub whereby said agitator is locked to said spin basket and said spin basket and said agitator can rotate freely within said wash tub.

* * * * *